US010759185B2

(12) United States Patent
Ueno et al.

(10) Patent No.: US 10,759,185 B2
(45) Date of Patent: Sep. 1, 2020

(54) SHEET, SHEET PROCESSING APPARATUS AND SHEET PROCESSING METHOD

(71) Applicant: SEIKO EPSON CORPORATION, Tokyo (JP)

(72) Inventors: Yoshihiro Ueno, Nagano (JP); Takumi Sago, Nagano (JP); Hiroki Kurata, Nagano (JP); Shunichi Seki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/446,763

(22) Filed: Jun. 20, 2019

(65) Prior Publication Data

US 2019/0389226 A1 Dec. 26, 2019

(30) Foreign Application Priority Data

Jun. 22, 2018 (JP) ..... 2018-118714

(51) Int. Cl.
*G03G 7/00* (2006.01)
*B41J 2/335* (2006.01)
*B41M 5/50* (2006.01)

(52) U.S. Cl.
CPC ..... *B41J 2/335* (2013.01); *B41M 5/502* (2013.01)

(58) Field of Classification Search
CPC ..... B41J 2/32; B41J 11/002; G03G 13/20; G03G 2215/00413
See application file for complete search history.

(56) References Cited

U.S. PATENT DOCUMENTS

2016/0229129 A1 8/2016 Ueno
2018/0072002 A1 3/2018 Ueno

FOREIGN PATENT DOCUMENTS

JP 2016-145427 A 8/2016
WO 2012/012724 A1 1/2012
WO 2017/162927 A1 9/2017

OTHER PUBLICATIONS

The Extended European Search Report for the corresponding European Patent Application No. 19181842.6 dated Oct. 14, 2019.

*Primary Examiner* — Kristal Feggins
(74) *Attorney, Agent, or Firm* — Global IP Counselors, LLP

(57) ABSTRACT

A sheet for a laser printer includes a plurality of fibers, and a binding agent for binding the plurality of fibers, in which an abundance of the binding agent on a surface of the sheet is smaller than an abundance of the binding agent in a center in a thickness direction of the sheet.

11 Claims, 6 Drawing Sheets

SHEET, SHEET PROCESSING APPARATUS AND SHEET PROCESSING METHOD

The present application is based on, and claims priority from JP Application Serial Number 2018-118714, filed Jun. 22, 2018, the disclosure of which is hereby incorporated by reference herein in its entirety.

BACKGROUND

1. Technical Field

The present disclosure relates to a sheet, a sheet processing apparatus and a sheet processing method.

2. Related Art

It has long been practiced to deposit fiber-like substances and exerting a binding force between the deposited fibers to thereby obtain sheet-like or film-like resultant products. A typical example is production of paper by papermaking using water. The apparatuses used for papermaking often require large-scale utilities such as water, electricity and drainage facilities, and are difficult to be down-sized. From these points of view, as an alternative to the papermaking, methods for manufacturing sheets using no or little water, which are called dry process, are expected.

JP-A-2016-145427 discloses a resin for use in manufacturing sheets in a dry process for binding fibers used for the sheets. Further, JP-A-2016-145427 also states that the resin is not easily detached from the fibers during manufacturing of sheets in a dry process.

However, the sheets formed by the dry process may not have sufficient rigidity in the heat treatment process such as when passing the heat roller. Thus, one of the performances required for sheets is sufficient rigidity in high temperature environment.

SUMMARY

An aspect of the disclosure is a sheet for a laser printer including a plurality of fibers, and a binding agent for binding the plurality of fibers, in which an abundance of the binding agent on a surface of the sheet is smaller than an abundance of the binding agent in a center in a thickness direction of the sheet.

In the above aspect of the sheet, a glass transition temperature Tg (° C.) of a resin contained in the binding agent, a temperature Ts (° C.) of the sheet after passing a heat treatment section in the laser printer, and a thickness D (μm) of the sheet may satisfy a formula (1):

$$Tg \geq Ts - 0.3 \times D \quad (1)$$

In the above aspect of the sheet, a surface resistivity Rs (Ω/□) of the sheet may be $1.0 \times 10^{12}$ (Ω/□) or less.

Another aspect of the disclosure is a method for processing a sheet, including applying heat treatment to a sheet including a plurality of fibers, and a binding agent for binding the plurality of fibers, in which a glass transition temperature Tg (° C.) of a resin contained in the binding agent, a temperature Ts (° C.) of the sheet after the heat treatment, and a thickness D (μm) of the sheet satisfy a formula (1):

$$Tg \geq Ts - 0.3 \times D \quad (1)$$

In the above aspect of the method for processing a sheet, the plurality of fibers may be bound by the applying heat treatment.

In the above aspect of the method for processing a sheet, a toner may be fixed to the sheet by the applying heat treatment.

Another aspect of the disclosure is a sheet processing apparatus, including a heat treatment section that applies heat to a sheet which includes a plurality of fibers, and a binding agent for binding the plurality of fibers, in which a glass transition temperature Tg (° C.) of a resin contained in the binding agent, a temperature Ts (° C.) of the sheet after passing the heat treatment section, and a thickness D (μm) of the sheet satisfy a formula (1):

$$Tg \geq Ts - 0.3 \times D \quad (1)$$

In the above aspect of the sheet processing apparatus, the plurality of fibers may be bound by the heat treatment section.

In the above aspect of the sheet processing apparatus may further include a pressurizing unit that pressurizes the sheet at a position upstream to the heat treatment section in a transport direction of the sheet.

In the above aspect of the sheet processing apparatus, the pressurizing unit may be a roller, and a material of a surface of the roller may include one or more of polysilicone, polyvinyl chloride, copolymer of acrylonitrile and 1,3-butadiene, and chloroprene rubber.

In the above aspect of the sheet processing apparatus, a toner may be fixed to the sheet by the heat treatment section.

In the above aspect of the sheet processing apparatus, the heat treatment section may be a heat roller.

DESCRIPTION OF EXEMPLARY EMBODIMENTS

Figure 1:
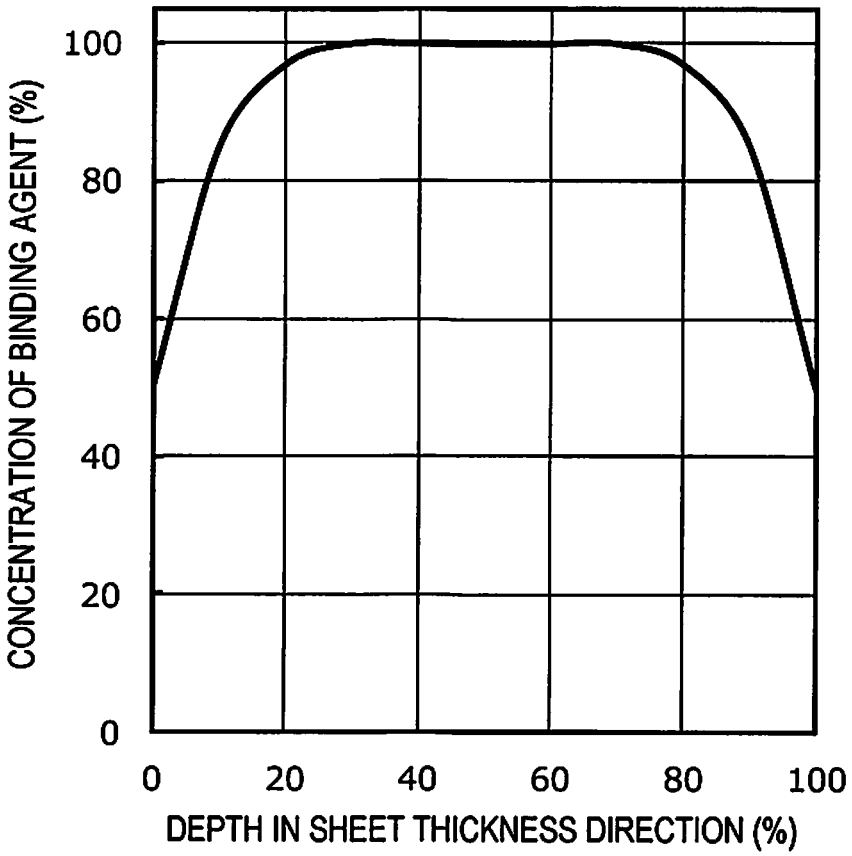
FIG. 1 is a graph showing an example of distribution of a binding agent in a thickness direction of a sheet according to an embodiment.

Hereinafter, some embodiments of the disclosure will be described. The embodiment described below is an example of the disclosure. The disclosure is not limited to the embodiments described below, and various modifications implemented without departing from the spirit of the disclosure are also included in the scope of the disclosure. Further, all the components described below are not necessarily essential to the disclosure.

1. Sheet

A sheet of the present embodiment includes a plurality of fibers and a binding agent for binding the plurality of fibers. Further, the sheet of the present embodiment is suitably used for a laser printer described below. An abundance of the binding agent on a surface of the sheet is smaller than that of the binding agent at a center of the sheet in the thickness direction. The following describes, in sequence, fibers, binding agent, distribution of binding agent in a sheet, and a method for forming distribution of binding agent in a sheet.

1.1. Fibers

In a sheet of the present embodiment, fibers are used as part of a raw material, and the sheet contains a plurality of fibers. Examples of such fibers include natural fibers (animal fibers, plant fibers), chemical fibers (organic fibers, inorganic fibers, organic-inorganic composite fibers) and the like. More specifically, examples of the fibers include fibers made of cellulose, silk, wool, cotton, hemp, kenaf, flax, ramie, jute, manila hemp, sisal hemp, coniferous trees, and hardwood trees. These can be used alone, mixed as appropriate, or as a recycled fiber after purification. Further, fibers may be dried, or may contain or be impregnated with water, liquid such as an organic solvent. Furthermore, fibers may be subjected to various surface treatments.

One of a plurality of fibers included in a sheet of the present embodiment, when regarded as a single independent fiber, has an average diameter, (if the section is not a circle, a maximum length in a direction perpendicular to the longitudinal direction, or a diameter of the circle when assuming a circle having an area equal to that of the sectional area (equivalent circle diameter)) in the range of 1 μm or more and 1000 μm or less.

The length of the fiber included in a sheet of the present embodiment is not particularly limited, and the length in the longitudinal direction of the fiber is in the range of 1 μm or more and 5 mm or less when regarded as a single independent fiber. Further, the average length of fiber is in the range of 20 μm or more and 3600 μm or less as a length—length-weighted mean fiber length. Moreover, the length of fiber may have variation (distribution).

The fiber described herein refers to a single piece of fiber, or refers to a group of a plurality of fibers (for example, a cotton-like state). The fiber may also be in the form of fibers (defibrated material) disentangled from a defibration object by a defibration process. Examples of the defibration object include fibers that are intertwined or bound together, such as pulp sheet, paper, waste paper, tissue paper, kitchen paper, cleaner, filter, liquid absorber, sound absorber, cushioning material, mat, and cardboard. Further, the defibration object described herein refers to a sheet of the present embodiment or the sheet after use (waste sheet). Examples of the defibration object include fibers made of materials such as rayon, lyocell, cupra, vinylon, acrylic, nylon, aramid, polyester, polyethylene, polypropylene, polyurethane, polyimide, carbon, glass, and metal (organic fibers, inorganic fibers, organic-inorganic composite fibers).

1.2. Binding Agent 1.2.1. Binding Agent

A sheet of the present embodiment includes a binding agent. The binding agent has a function of binding fibers together. The binding agent may also have other functions in addition to binding fibers together. Further, the binding agent may not always perform a specific function. The binding agent may be a composite including a coloring agent, coagulation inhibitor, and the like. The binding agent may also include organic solvents, surfactants, fungicides, antiseptics, antioxidants, ultraviolet absorbents, oxygen absorbents, and the like.

The binding agent can impart functions to sheets, including binding between fibers, coloring, adhesion or pressure-sensitive adhesion between sheets or between a sheet and other substance, and flame retardancy of sheet. Further, the binding agent may also have functions of preventing other functional materials (e.g., coloring agents) from removing from a sheet. The binding agent may be in the form of either particles or fibers as primary particles. The binding agent, regardless of whether it is in the form of particles or fibers as primary particles, is mixed with fibers as a powder and blended in the sheet.

The binding agent includes resins. The resins may be either natural resin or synthetic resin, or may be either thermoplastic resin or heat-curable resin. Preferably, the thermoplastic resin is used when the effect by heat and pressure is expected, that is, when the binding agent is intended to be melted. Further, when it is desired to improve water resistance of the sheet, the resin contained in the binding agent is preferably non-water soluble.

Examples of the natural resin include rosin, dammar, mastic, copal, amber, shellac, dragon's blood tree resin, sandarac, and colophonium. These can be used alone, mixed as appropriate, or modified as appropriate. Among synthetic resins, examples of the heat-curable resin include phenol resin, epoxy resin, melamine resin, urea resin, unsaturated polyester resin, alkyd resin, polyurethane resin, and thermosetting polyimide resin. Further, among synthetic resins, examples of the thermoplastic resin include AS resin, ABS resin, polypropylene, polyethylene, polyvinyl chloride, polystyrene, acrylic resin, polyester resin, polyethylene terephthalate, polyphenylene ether, polybutylene terephthalate, nylon, polyamide, polycarbonate, polyacetal, polyphenylene sulfide, and polyether ether ketone. These resins can be used singly or mixed as appropriate. In addition, copolymerization and modification may also be performed. Examples of such resins include styrene-based resin, acrylic resin, styrene-acrylic copolymer resin, olefin-based resin, vinyl chloride-based resin, polyester-based resin, polyamide-based resin, polyurethane-based resin, polyvinyl alcohol-based resin, vinyl ether-based resin, N-vinyl-based resin, and styrene-butadiene-based resin.

Further, resins included in the binding agent is preferably melted or softened at the temperature of 200° C. or lower, and more preferably melted or softened at the temperature of 160° C. or lower in view of the energy saving.

While it seems preferable for the resin contained in the binding agent to have high glass transition temperature (Tg) in view of high-temperature resistance, it is assumed that there is an appropriate range considering factors such as energy saving in manufacturing of resins and binding agents. For example, the range can be appropriately selected depending on the sheet thickness, temperature for heat treatment, or the like in accordance with the conditions described later. The temperature is preferably 45.0° C. or more, and more preferably 50.0° C. or more. Further, the upper limit of Tg is preferably 95.0 degrees or less, and more preferably 90.0° C. or less. When the glass transition temperature is 45.0° C. or more, softening of the binding agent at high temperature is reduced, and the sheet with high rigidity can be obtained.

The binding agent is preferably a powder made of particles having a volume average grain diameter smaller than the diameter of fiber. If the binding agent is powder, the compounding quantity to fiber can be easily modified. Further, when it is powder, the uniformity in adhesion to fibers can be improved. In addition, in order to achieve uniform fiber adhesion of powder, electrostatic repulsion between particles of the binding agent is of importance. Accordingly, the binding agent which is easily chargeable (for example, highly insulating) is preferred.

The binding agent can be obtained, for example, by kneading using a kneader, Banbury mixer, single screw extruder, multi-screw extruder, two-roll, three-roll, continuous kneader, continuous two-roll, or the like, followed by pelletizing and crushing by appropriate techniques. The binding agent may contain particles of various sizes, and may be classified by using a known classifier. Further, the outer shape of the particles of the binding agent is not particularly limited, and may be spherical, disk-like, fiber-like, or irregular shapes.

The term "binding between the fiber and the biding agent" as used herein refers to a state in which the fiber and the binding agent are not easily separable or a state in which the binding agent is provided between fibers and the fibers are not easily separable via the binding agent. Further, binding is a concept that includes adhesion, and includes a state in which two or more types of substances are in contact with each other and difficult to separate from each other. When the fibers are bound together via the binding agent, the fibers may be parallel or intersect, or a plurality of fibers may be bound to a single fiber.

In the sheet of the present embodiment, methods for binding fibers together are not particularly limited as long as the binding agent is melted or softened to bind between fibers. Configurations that achieve such binding include, for example, a heat press, a heat roller, and the like. Further, the configurations may include a hot press molding machine, a hot plate, a hot air blower, an infrared heater, a flash fixing device, and the like, or may include a calendar roller.

1.3. Distribution of Binding Agent in Sheet

A sheet according to the present embodiment has a front surface as a first surface, and a rear surface as a second surface on a side opposite to the first surface. The front surface and the rear surface can be selected as appropriate. Accordingly, the surface described hereinbelow refers to a first surface and/or a second surface (rear surface) of the sheet. In the sheet of the present embodiment, an abundance of the binding agent on the surface of the sheet is smaller than that of the binding agent at a center of the sheet in the thickness direction. FIG. 1 is a graph schematically showing an example of distribution of a binding agent in a sheet of the present embodiment.

In FIG. 1, the horizontal axis of the graph represents the position in the thickness direction as a percentage (%) relative to the sheet thickness when the total thickness of the sheet is taken as 100%, and the vertical axis represents the percentage (%) of the abundance of the binding agent when the abundance of the binding agent present in the center part of the sheet in the thickness direction is taken as 100%. That is, in FIG. 1, the horizontal axis of the graph normalizes the depth in the sheet thickness direction by the sheet thickness, and the vertical axis normalizes the concentration of the binding agent by the concentration of the binding agent present in the center part of the sheet in the thickness direction.

As shown in FIG. 1, the distribution of the binding agent in the thickness direction of the sheet of the present embodiment increases near the center in the thickness direction, and decreases at both ends in the thickness direction (front surface or rear surface of the sheet). The center of the sheet in the thickness direction may have a specific range, which may be the range of one-third of the total thickness including the center in the sheet thickness direction, and more preferably the range of one-fourth of the total thickness including the center in the sheet thickness direction. Further, the both ends of the sheet in the thickness direction may be the range of one-third of the total thickness from the sheet surface toward the center in the sheet thickness direction, and more preferably the range of one-fourth of the total thickness from the sheet surface toward the center in the sheet thickness direction.

When the abundance of the binding agent at the center of the sheet in the thickness direction is taken as 100.0%, the abundance of the binding agent near the surface of the sheet is in the range of 20.0% or more and 80.0% or less, preferably 30.0% or more and 70.0% or less, more preferably 35.0% or more and 65.0% or less, and yet more preferably 40.0% or more and 60.0% and less. When the distribution of the binding agent in the sheet is within these ranges, the sheet is not likely to be adhered to a heat treatment section such as a heat roller or the like when passing through the heat roller, and can also obtain sheet rigidity when passing through the heat roller. The rigidity of sheet can also be regarded as resiliency of sheet.

In the illustrated example, the distribution of the binding agent is symmetrical with respect to the center of the sheet in the thickness direction, but may also be asymmetrical as long as the abundance of the binding agent decreases at the front surface and the rear surface. The concentration of the binding agent can be measured by the ATR measured, for example, by using a Fourier transform infrared spectrometer (FTIR). The measurement can be performed for each exposed surface while scraping the sheet surface by each predetermined thickness. Thus, the abundance ratio and the distribution of the binding agent in the sheet thickness direction can be obtained. Alternatively, the measurement can also be performed by observing, and imaging if necessary, the section of the sheet by an electronic microscope or the like.

1.4. Methods for Forming Distribution of Binding Agent in Sheet

Figure 2:
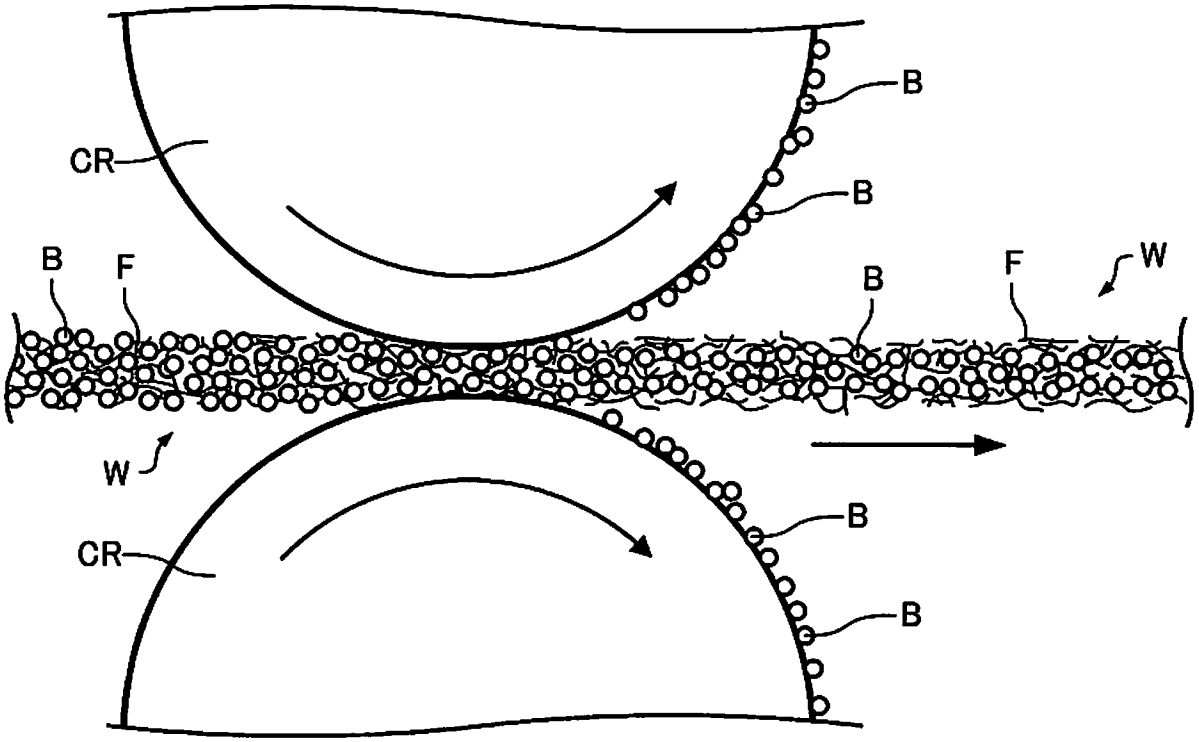
FIG. 2 is a schematic diagram illustrating an example of a method for forming distribution of a binding agent in a sheet.
Figure 3:
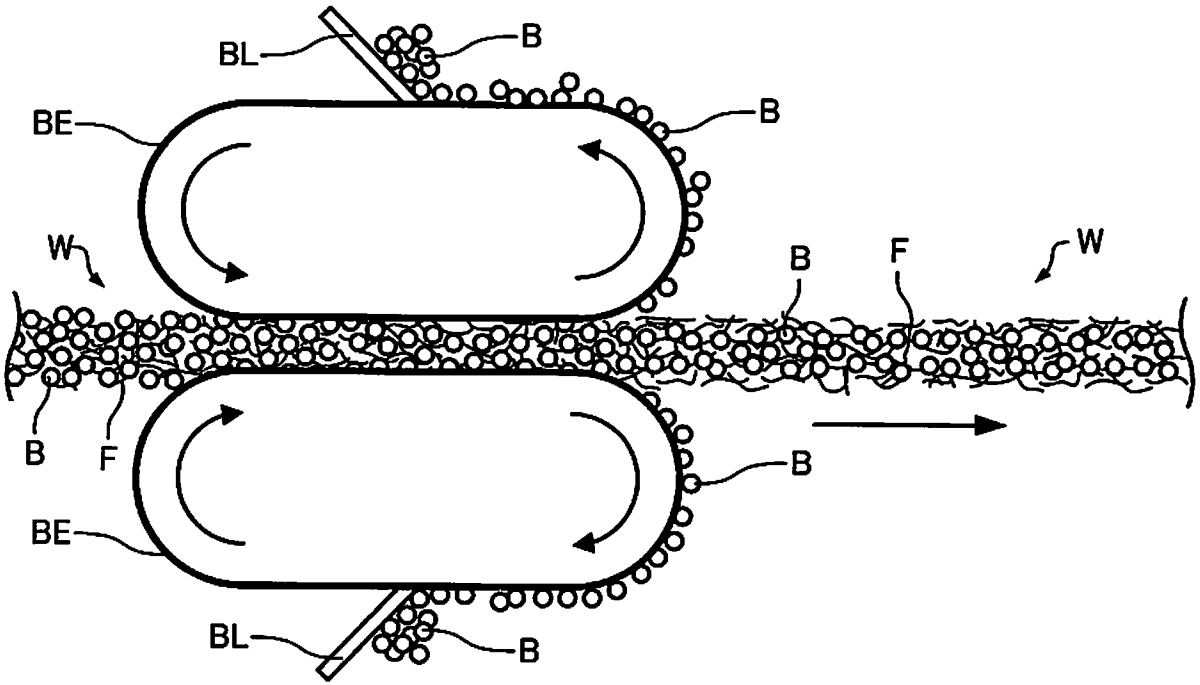
FIG. 3 is a schematic diagram illustrating an example of a method for forming distribution of a binding agent in a sheet.
Figure 4:
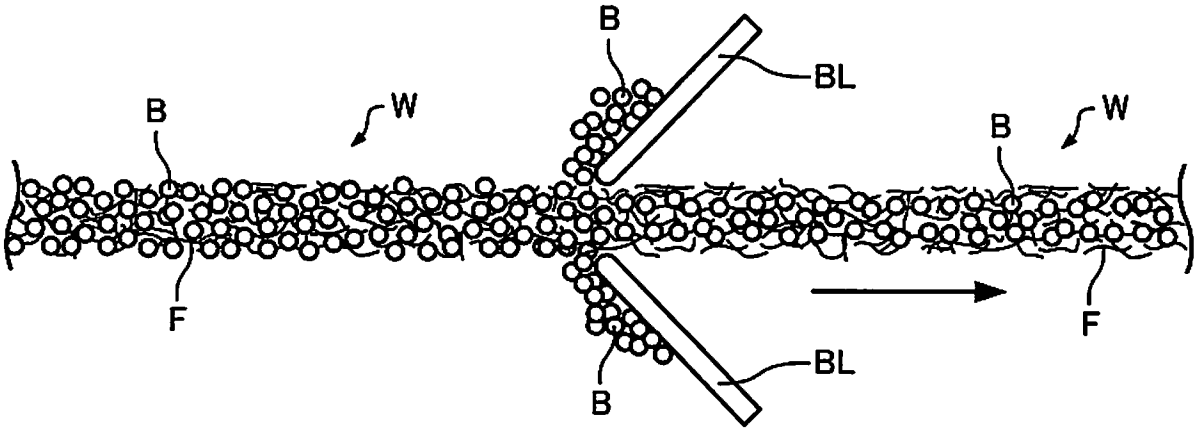
FIG. 4 is a schematic diagram illustrating an example of a method for forming distribution of a binding agent in a sheet.

Methods for forming distribution of binding agent in sheet of the present embodiment include passing the deposit of a mixture of the fiber and the binding agent between a pair of rollers, passing the deposit between a pair of belts, scraping the deposit with a blade, and the like. FIGS. 2 to 4 show examples of these methods. For the convenience of description, the dimensions, scale, compounding ratio of the members, fibers, binding agents are different from the actual ones.

FIG. 2 schematically illustrates that the deposit of a mixture of the above-mentioned fiber and the above-mentioned binding agent is transported by a pair of rollers. In FIG. 2, the deposit of the mixture of the fiber and the binding agent is denoted by reference character W, the fiber is denoted by reference character F, and the binding agent is denoted by reference character B. Further, the roller is denoted by reference character CR. Distribution of the binding agent in the sheet of the present embodiment can be formed by causing the deposit W of the mixture of the fiber F and the binding agent B (hereinafter, also referred to as a "web") without the binding agent melted therein to pass through the nip between a pair of rollers CR prior to melting of the binding agent. In this case, distribution of the binding agent B of the present embodiment can be achieved before the fibers F are bound together by the binding agent B.

One of the reasons that the binding agent B can be removed in the embodiment shown in FIG. 2 is because the binding agent B near the surface of the web W is transferred to the surface of the roller CR due to peeling-off since the web W is fed between the rollers CR before heat-setting of the binding agent. Further, an appropriate bias voltage can be applied to the roller CR to adjust the concentration and distribution of the binding agent B in the web W by using electrostatic force. According to this embodiment, the concentration of the binding agent B near the surface can be reduced by a simple technique. Moreover, the temperature of the roller CR can be adjusted to improve efficiency of adhesion to the roller CR by using tack of the binding agent.

Although materials for the roller CR is not particularly limited, a metal such as iron and SUS is preferred in view of transfer behavior due to peeling-off. The surface of the roller CR may be subjected to appropriate surface treatments. Further, the surface of the roller CR may be, for example, subjected to coating or lining by at least one of polysilicone, polyvinyl chloride, copolymer of acrylonitrile and 1,3-butadiene, and chloroprene rubber. Thus, the binding agent B can be efficiently removed from the surface of the web W, and the binding agent B transferred to the roller CR can be easily peeled off from the roller CR. Although the configuration for removing the binding agent B from the roller CR is not illustrated in the embodiment of FIG. 2, the binding agent B can be easily removed by providing a blade, for example. Such a blade is similar to the embodiment of FIG. 3 described below.

FIG. 3 schematically illustrates that the deposit of a mixture of the above-mentioned fiber and the above-mentioned binding agent is transported by a pair of belts. Reference characters W, F, and B in FIG. 3 are the same as those in FIG. 2. The belt is denoted by reference character BE, and the blade is denoted by reference character BL. Distribution of the binding agent B in the sheet of the present embodiment can be formed by causing the web W without the binding agent B melted therein to pass through the nip between a pair of belts BE prior to melting of the binding agent B. In this case as well, distribution of the binding agent B of the present embodiment can be achieved before the fibers F are bound together by the binding agent B.

As shown in FIG. 3, the same effect as the above-mentioned roller CR (see FIG. 2) can be obtained by using a contact member such as the belt BE. Examples of the material of the belt BE include metal, metal oxide, resin, elastomer, and paper, which can be selected in accordance with the application, and may be subjected to surface treatment, coating, or the like. In the embodiment of FIG. 3, a blade BL is provided as the configuration for removing the binding agent B from the belt BE. The blade BL abuts a portion of the belt BE where the belt BE and the web W are not in contact with each other. Thus, the binding agent B can be easily removed from the belt BE. Such a blade BL can be applied to the above-mentioned roller CR. The blade BL may also be subjected to surface treatments, coating, and the like.

FIG. 4 schematically illustrates that the deposit of a mixture of the above-mentioned fiber and binding agent is rubbed by blades. Reference characters W, F, B, and BL in FIG. 4 are the same as those in FIG. 3. Distribution of the binding agent B in the sheet of the present embodiment can also be formed without the binding agent B melted therein by rubbing the web W with the blade BL abutting against the front and rear surfaces of the web W prior to melting of the binding agent B. In the example of FIG. 4, the blade BL abuts against the traveling web W. However, it should be noted that it is sufficient if the web W and the blade BL move relative to each other. Further, in the example of FIG. 4, two blades BL on the front and rear surfaces are positioned symmetrically with respect to the web W. However, they may not be positioned symmetrically. The blade BL may also be subjected to surface treatments or coating. Thus, distribution of the binding agent B of the present embodiment can also be achieved before the fibers F are bound together by the binding agent B by rubbing the web W by the blade BL abutting thereon.

The web W, in which a predetermined distribution of the binding agent B is achieved, can be subjected to heat treatment such as a heat roller to form a sheet. Thus, a sheet having the distribution of the binding agent B of the present embodiment can be formed. The form of heat treatment is not particularly limited.

Among the methods described above, one method may be used a plurality of times, or the methods may be used in combination. Further, among the methods described above, the one using the pair of rollers CR as shown in FIG. 2 is suitable for adjusting the concentration of the binding agent B at the sheet surface of the sheet, and the one using peeling-off of the binding agent B is of low cost and easy to use. The peeling-off refers to peeling separation of the binding agent B from the surface of the web W. In addition, since this technique can be easily implemented by simply providing a heat roller at a position downstream to the pair of rollers, for example, for feeding the web W through the heat rollers after the concentration of the binding agent B is adjusted. Accordingly, the configuration of the apparatus for forming a sheet from the web W can be easily reduced in size.

With the configuration described above, the concentration distribution as shown in FIG. 1 can be formed for the concentration of the binding agent in the sheet depth direction. By virtue of such distribution, the tack of the melted resin to the process surface of the heat roller or the like can be reduced while ensuring the binding force of the fiber at the surface of the sheet. Moreover, since the sufficient concentration of the binding agent inside the sheet can be ensured, the rigidity and strength of the sheet can be maintained. As a result, the rigidity and strength of the sheet during heat treatment process can be ensured to thereby facilitate, for example, passing through the high temperature process such as a heat roller. Therefore, the sheet of the present embodiment is suitably used for a laser printer which involves passing through the high temperature process such as a heat roller. The laser printer will be detailed later.

1.5. Surface Resistivity of Sheet

As described above, in the sheet of the present embodiment, the abundance of the binding agent near the surface is lower than that inside the sheet. Accordingly, the sheet has a smaller surface resistivity compared with a sheet with approximately the same abundance of the binding agent near the surface and inside the sheet.

Surface resistivity is a type of quantity that represents the electrical resistance of a film-like object, which is also called sheet resistance or sheet resistivity. Since the dimensions of surface resistivity are the same as the dimensions of electrical resistance, the unit is SI. In this description, however, Ω per square (Ω/□) (ohms per square) is used as the unit. This value can be interpreted as the resistance of current in a square area of any size when it flows from one end to the opposite end.

The surface resistivity of the sheet of the present embodiment is in the range of $1.0\times10^{12}$ (Ω/□) or less, preferably $9.9\times10^{11}$ (Ω/□) or less, more preferably $9.0\times10^{11}$ (Ω/□) or less, and yet more preferably $7.5\times10^{11}$ (Ω/□) or less. The surface resistivity of the sheet of the present embodiment is close to the surface resistivity of the paper manufactured by wet papermaking. In addition, the surface resistivity of the sheet is in the order of one-third or less of that of the sheet manufactured by dry papermaking and having approximately the same abundance of the binding agent near the surface and inside the sheet.

Since the sheet of the present embodiment has a low surface resistivity, occurrence of static electricity is reduced. For example, when the sheet travels in the apparatus at high speed, static electricity occurring due to the friction with the apparatus member is low, and thus good traveling ability is easily ensured. In addition, since the sheet is less likely to be subjected to electrostatic charges, stackability in the tray or the like is improved. Further, since sticking between sheets is reduced, ease of handling of sheets is improved. Such effects are more pronounced in low humidity environments.

1.6. Shapes of Sheets

The sheet of the present embodiment may be in the form of a board, a web, or a shape having irregularities. Further, the sheet of the present embodiment can be classified as paper or non-woven fabric. Paper includes, for example, sheet-shaped materials made of pulp, waste paper or the like, including recording papers for writing and printing, wallpapers, wrapping papers, colored papers, drawing papers, Kent papers, and the like. Non-woven fabrics have larger thickness and lower density than paper, and include general non-woven fabrics, fiber boards, tissue papers, kitchen papers, cleaners, filters, liquid absorbers, sound absorbers, cushioning materials, mats, and the like. Further, ink can be applied to paper or non-woven fabrics to form characters and images. In addition, although it is common to apply ink to paper, ink can also be applied to non-woven fabrics to form information such as product names, serial numbers, applications, notes, and the like, or to form images for decoration.

2. Sheet Processing Apparatus

The sheet processing apparatus of the present embodiment is an apparatus having a heat treatment section for heating a sheet and can perform heat treatment. One aspect of the sheet processing apparatus is a sheet manufacturing apparatus. That is, one aspect of the processing is manufacturing. Further, one aspect of the sheet processing apparatus is a laser printer. That is, one aspect of the processing is printing by laser printer. Hereinafter, an essential part of the sheet manufacturing apparatus and the laser printer will be described.

2.1. Sheet Manufacturing Apparatus

Figure 5:
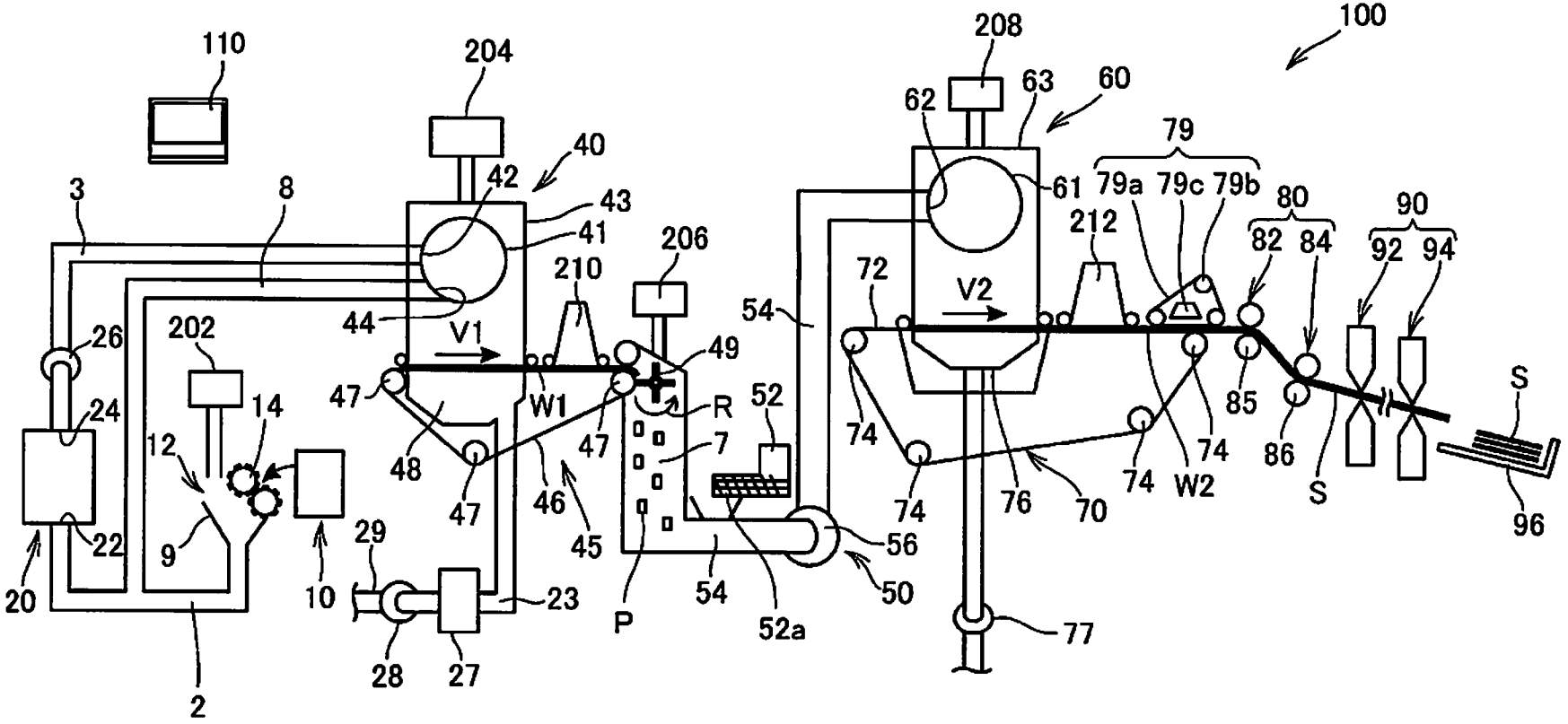
FIG. 5 is a diagram schematically illustrating an example of a sheet manufacturing apparatus according to an embodiment.

FIG. 5 is a schematic diagram illustrating a configuration of a sheet manufacturing apparatus 100 according to an embodiment.

The sheet manufacturing apparatus 100 described in the present embodiment is an apparatus suitable for manufacturing new paper, in which used waste papers such as confidential papers, used as raw materials, are subjected to dry-defibration and fiberization, followed by pressing, heating, and cutting. Various additives can be mixed with the fiberized raw materials to improve binding strength and whiteness of paper products or to impart functions such as color, aroma, and flame retardancy in accordance with the application. In addition, the density, thickness, and shape of the paper can be controlled to manufacture paper products of various thicknesses and sizes, such as A4 and A3 office paper sheets and business card paper sheets, in accordance with the application.

The sheet manufacturing apparatus 100 includes a supplying unit 10, a crushing unit 12, a defibrating unit 20, a screening unit 40, a first web forming unit 45, a rotating member 49, a mixing unit 50, a deposition unit/accumulating unit 60, a second web forming unit 70, a transport unit 79, a sheet forming unit 80, a cutting unit 90, and a control unit 110.

Further, the sheet manufacturing apparatus 100 includes humidification units 202, 204, 206, 208, 210, and 212 for humidifying the raw material, and/or for humidifying a space in which the raw material moves. The specific configuration of the humidification units 202, 204, 206, 208, 210, and 212 is optional, and may be a steam type, a vaporization type, a warm air vaporization type, an ultrasonic type, or the like.

In the present embodiment, the humidification units 202, 204, 206, and 208 are configured with a vaporizer humidifier or a warm-air vaporizer humidifier. That is, the humidification units 202, 204, 206, and 208 have a filter (not shown) for infiltrating water, and supply humidified air with increased humidity by allowing air to pass through the filter. In addition, the humidification units 202, 204, 206, and 208 may include a heater (not shown) that effectively increases the humidity of the humidified air.

Further, in the present embodiment, the humidification unit 210 and the humidification unit 212 are configured with ultrasonic humidifiers. That is, the humidification units 210 and 212 have a vibrating unit (not shown) for atomizing water, and supply mist generated by the vibrating unit.

The supplying unit 10 supplies a raw material to the crushing unit 12. The raw material for producing sheets in the sheet manufacturing apparatus 100 may be any material containing fiber, and examples of the material include paper, pulp, pulp sheet, cloth including non-woven fabric, and woven fabric. In the present embodiment, an exemplary configuration of the sheet manufacturing apparatus 100 which uses waste paper as a raw material will be described. The supplying unit 10 can be configured with, for example, a stacker that accommodates stacked waste papers, and an automatic feeder that feeds out the waste papers from the stacker to the crushing unit 12.

The crushing unit 12 cuts (crushes) the raw material supplied by the supply unit 10 with a crushing blade 14 into coarse fragments. The crushing blade 14 cuts the raw material in the atmosphere (in the air) and the like. The crushing unit 12 includes, for example, a pair of crushing blades 14 for pinching and cutting the raw material, and a drive unit for rotating the crushing blades 14 so that it has the same configuration as a shredder. The shape and size of the coarse fragments are not limited, as long as they are suitable for defibration treatment by the defibrating unit 20. The crushing unit 12 cuts the raw material into pieces of paper with a size of, for example, 1 to several cm square or less.

The crushing unit 12 has a chute (hopper) 9 which receives coarse fragments which are cut by the crushing blade 14 and fall into the chute 9. The chute 9 has, for example, a tapered shape having a width gradually decreasing in a flow direction (traveling direction) of the coarse fragments. Accordingly, the chute 9 can receive many coarse fragments. The chute 9 is connected to a pipe 2, which communicates with the defibrating unit 20, such that the pipe 2 forms a transport path for transporting the raw material (coarse fragments) cut by the crushing blade 14 to the defibrating unit 20. The coarse fragments are collected by the chute 9, and fed (transported) to the defibrating unit 20 via the pipe 2. The coarse fragments are transported in the pipe 2 toward the defibrating unit 20 by means of, for example, air flow generated by a blower (not shown).

Humidified air is supplied by the humidification unit 202 to or near the chute 9 of the crushing unit 12. As a result, it is possible to reduce occurrence of the phenomenon in which the crushed materials cut by the crushing blade 14 are attracted to the inner surface of the chute 9 or the pipe 2 due to static electricity. Further, since the crushed materials cut by the crushing blade 14 are transported to the defibrating unit 20 together with humidified (high humidity) air, the effect of suppressing the adhesion of the defibrated material inside the defibrating unit 20 can also be expected. Alternatively, the humidification unit 202 may be configured to supply humidified air to the crushing blade 14 to electrically neutralize the raw material supplied by the supplying unit 10. In addition, the electric neutralization can also be performed by using an ionizer together with the humidification unit 202.

The defibrating unit 20 defibrates the crushed materials cut by the crushing unit 12. More specifically, the defibrating unit 20 defibrates the raw material (coarse fragments) cut by the crushing unit 12 to generate a defibrated material. The term "defibrate" as used herein refers to disentangle the raw material (defibration object) made of a plurality of fibers bound together into pieces of fibers. The defibrating unit 20 also has a function of separating substances such as resin particles, ink, toner, and blur-preventing agent attached to the raw material from the fibers.

Materials which have passed the defibrating unit 20 are called "defibrated materials." The "defibrated material" may contain, in addition to the disentangled defibrated material fibers, particles of resin (resin for binding a plurality of fibers together) separated from fibers when the fibers are disentangled, color materials such as ink and toner, additives such as blur-preventing agent and paper strength enhancing agent. The disentangled defibrated material is in the form of a string or a ribbon. The disentangled defibrated material may exist in a state of not being intertwined with other disentangled fibers (independent state), or in a state of being intertwined with other disentangled defibrated materials and forming lumps (in other words, "lump state").

The defibrating unit 20 performs dry defibration. Dry defibration refers to processing such as defibration performed in the atmosphere (in the air) rather than in liquid. In the present embodiment, the defibrating unit 20 is configured to use an Impeller mill. Specifically, the defibrating unit 20 includes a rotor (not shown) rotating at a high speed and a liner (not shown) positioned on the outer periphery of the rotor. The coarse fragments cut by the crushing unit 12 are pinched between the rotor and the liner of the defibrating unit 20 and defibrated. The defibrating unit 20 generates an air flow by rotation of the rotor. By this air flow, the defibrating unit 20 can suction the coarse fragments, which are the raw material, from the pipe 2 and transport the defibrated material to an outlet port 24. The defibrated material is fed out from the outlet port 24 into a pipe 3, and to the screening unit 40 via the pipe 3.

Thus, the defibrated material generated by the defibrating unit 20 is transported from the defibrating unit 20 to the screening unit 40 by means of air flow generated by the defibrating unit 20. Furthermore, in the present embodiment, the sheet manufacturing apparatus 100 is provided with a defibrating unit blower 26, which is an air flow generating device, such that the defibrated material is transported to the screening unit 40 by the air flow generated by the defibrating unit blower 26. The defibrating unit blower 26 is attached to the pipe 3, and suctions air together with defibrated material from the defibrating unit 20, and blows it to the screening unit 40.

The screening unit 40 has an inlet port 42 through which the defibrated material defibrated by the defibrating unit 20 flows from the pipe 3 together with the air flow. The screening unit 40 screens the defibrated material to be introduced into the inlet port 42 by the length of the fiber. Specifically, the screening unit 40 screens, among the defibrated materials defibrated by the defibrating unit 20, the defibrated material of a predetermined size or less as a first screened product and the defibrated material larger than the first screened product as a second screened product. The first screened product contains fibers or particles and the like, and the second screened product contains, for example, large fibers, undefibrated pieces (coarse fragments that are not sufficiently defibrated), and lumps made of the defibrated fibers that are aggregated or intertwined each other.

In the present embodiment, the screening unit 40 includes a drum unit (sieve unit) 41, and a housing unit (cover unit) 43 that houses the drum unit 41.

The drum unit 41 is a cylindrical sieve rotationally driven by a motor. The drum unit 41 has a mesh (filter, screen), and functions as a sieve. Due to the mesh, the drum unit 41 screens the first screened product smaller than the size of the mesh aperture (opening) and the second screened product larger than the mesh aperture. The mesh of the drum unit 41 may be, for example, a wire netting, an expanded metal which is obtained by extending a metal plate with cuts, or a punching metal formed by punching apertures in a metal plate by a press machine or the like.

The defibrated material introduced into the inlet port 42 is fed into the drum unit 41 together with the air flow, and the first screened product falls downward from the mesh of the drum unit 41 by rotation of the drum unit 41. The second screened product that cannot pass through the mesh of the drum unit 41 is fed by the air flow flowing into the drum unit 41 from the inlet port 42 and introduced to an outlet port 44 and into a pipe 8.

The pipe 8 connects the inside of the drum unit 41 to the pipe 2. The second screened product, which is fed through the pipe 8, flows through the pipe 2 together with the coarse fragments cut by the crushing unit 12, and is introduced to an inlet port 22 of the defibrating unit 20. As a result, the second screened product is returned to the defibrating unit 20 and defibrated.

Further, the first screened product screened by the drum unit 41 disperses in the air through the mesh of the drum unit 41, and falls toward a mesh belt 46 of the first web forming unit 45 located under the drum unit 41.

The first web forming unit 45 (separation unit) includes the mesh belt 46 (separation belt), rollers 47, and a suction unit (suction mechanism) 48. The mesh belt 46 is an endless belt, and is carried by three rollers 47 and transported by the movement of the rollers 47 in a direction indicated by the arrow in the figure. The surface of mesh belt 46 is configured by a mesh in which openings of a predetermined size are arranged. Among the first screened products falling from the screening unit 40, fine particles of the size that pass through the mesh fall under the mesh belt 46, and the fibers of the size that does not pass the mesh are deposited on the mesh belt 46, and transported together with the mesh belt 46 in the arrow direction. The fine particles falling from the mesh belt 46 include relatively small or low density materials (such as resin particles, colorants, and additives) among the defibrated materials. These are removal material that the sheet manufacturing apparatus 100 does not use for manufacturing a sheet S.

The mesh belt 46 moves at a constant speed V1 during normal operation for manufacturing the sheet S. The normal operation described herein refers to the operation except for the start control and stop control of the sheet manufacturing apparatus 100, and more specifically, operation for manufacturing the sheet S of the desired quality by the sheet manufacturing apparatus 100.

Accordingly, the defibrated material defibrated by the defibrating unit 20 is screened into the first screened products and the second screened products by the screening unit 40, and the second screened product is returned to the defibrating unit 20. Further, removal material is removed from the first screened product by the first web forming unit 45. The remainder of the first screened product excluding the removal material is a material suitable for manufacturing the sheet S, and this material is deposited on the mesh belt 46 to form a first web W1.

The suction unit 48 suctions air from the lower side of the mesh belt 46. The suction unit 48 is connected to a dust collecting unit 27 via a pipe 23. The dust collecting unit 27 is a filter-type or cyclone-type dust collecting device, and separates fine particles from the air flow. A collection blower 28 is provided at a position downstream to the dust collecting unit 27, and the collection blower 28 functions as a dust collecting suction unit for suctioning air from the dust collecting unit 27. Further, the air exhausted from the collection blower 28 is exhausted outside the sheet manufacturing apparatus 100 via a pipe 29.

In this configuration, air is suctioned from the suction unit 48 through the dust collecting unit 27 by the collection blower 28. In the suction unit 48, fine particles passing through the mesh of the mesh belt 46 are suctioned together with the air, and fed to the dust collecting unit 27 through the pipe 23. The dust collecting unit 27 separates fine particles that have passed through the mesh belt 46 from the air flow, and accumulates the fine particles.

Thus, the fibers, which remain after the removal materials have been removed from the first screened product, are deposited on the mesh belt 46 to form the first web W1. Suctioning performed by the collection blower 28 promotes formation of the first web W1 on the mesh belt 46, and the removal materials are rapidly removed.

The humidification unit 204 supplies humidified air to the space including the drum unit 41. This humidified air humidifies the first screened product in the screening unit 40. This can reduce adhesion of the first screened product to the mesh belt 46 due to electrostatic force, and facilitate peeling of the first screened product from the mesh belt 46. Furthermore, it is possible to reduce adhesion of the first screened product to the rotating member 49 and the inner wall of the housing part 43 due to electrostatic force. Further, the removal material can be efficiently suctioned by the suction unit 48.

In the sheet manufacturing apparatus 100, the configuration for screening and separating the first defibrated material and second defibrated material is not limited to the screening unit 40 provided with the drum unit 41. For example, a configuration that classifies the defibrated material defibrated by the defibrating unit 20 by using a classifier can also be used. Examples of the classifier include a cyclone classifier, elbow-jet classifier, and Eddy classifier. By using these classifiers, it is possible to screen and separate the first screened product and the second screened product. Furthermore, with the above-mentioned classifiers, it is possible to realize a configuration in which removal materials including defibrated materials having relatively small or low density (resin particles, colorants, additives, etc.) among the defibrated materials are separated and removed. For example, fine particles contained in the first screened product may be removed from the first screened product by using a classifier. In this case, the second screened product may be returned to, for example, the defibrating unit 20, the removal materials may be collected by the collecting unit 27, and the first screened product excluding the removal materials may be fed to a pipe 54.

In the transport path of the mesh belt 46, air which contains mist is supplied at a position downstream to the screening unit 40 by the humidification unit 210. Mist, which is fine particles of water generated by the humidification unit 210, falls toward the first web W1 and supplies moisture to the first web W1. As a result, the amount of water contained in the first web W1 can be adjusted, and adhesion of fibers to the mesh belt 46 due to static electricity can be reduced.

The sheet manufacturing apparatus 100 includes the rotating member 49 that divides the first web W1 deposited on the mesh belt 46. The first web W1 is peeled off from the mesh belt 46 at a position where the mesh belt 46 turns back by the roller 47, and is divided by the rotating body 49.

The first web W1 is a soft material in which fibers are deposited to form a web, and the rotating member 49 disentangles the fibers of the first web W1 and processes them so that the resin can be easy mixed therewith in the mixing unit 50, described later.

Although the configuration of the rotating member 49 is optional, the rotating member 49 in the present embodiment can be in the form of a rotating blade having a plate-like rotating blade. The rotating body 49 is disposed at a position where the first web W1 separating from the mesh belt 46 is in contact with the blade. The first web W1 separated from the mesh belt 46 and transported collides with the blade due to rotation of the rotating member 49 (rotation to a direction indicated by an arrow R in the drawing) to form a subdivided material P.

The rotating member 49 is preferably disposed at a position where blades of the rotating member 49 do not collide with the mesh belt 46. For example, a distance between the blade tip of the rotating member 49 and the mesh belt 46 can be 0.05 mm or more and 0.5 mm or less. In this case, the first web W1 can be efficiently divided by the rotating member 49 without damaging the mesh belt 46.

The subdivided material P divided by the rotating material 49 moves downward in the pipe 7, and is transported to the mixing unit 50 by air flow flowing in the pipe 7.

Further, humidified air is supplied to a space including the rotating member 49 by the humidification unit 206. Accordingly, it is possible to reduce occurrence of the phenomenon in which fibers are attracted to the inside of the tube 7 and the blades of the rotating member 49 by static electricity. In addition, since humid air is supplied to the mixing unit 50 through the pipe 7, the influence of static electricity can also be reduced in the mixing unit 50.

The mixing unit 50 includes an additive agent supply unit 52 for supplying an additive which contains resin, the pipe 54 which communicates with the pipe 7 and through which air flow containing the subdivided material P flows, and a mixing blower 56. The additive described herein includes the above-mentioned binding agent. Further, the additive may also be the above-mentioned binding agent per se.

The subdivided material P is a fiber which remains after the removal material is removed from the first screened product which has passed the screening unit 40 as described above. The mixing unit 50 mixes the fiber constituting the subdivided material P with an additive which contains resin.

In the mixing unit 50, the mixing blower 56 generates air flow to mix the subdivided material P and an additive in the pipe 54 and transport the mixture. Further, the subdivided material P is disentangled while flowing in the pipe 7 and the pipe 54, and becomes a finer fiber.

The additive agent supply unit 52 is connected to an additive cartridge (not shown) that accumulates an additive so as to supply the additive in the additive cartridge to the pipe 54. The additive cartridge may be attachable to and detachable from the additive agent supply unit 52. Further, the additive cartridge may be provided with a configuration for replenishing the additive. The additive agent supply unit 52 temporarily stores the additive including fine powder or fine particles in the additive cartridge. The additive agent supply unit 52 has an output unit 52*a* for feeding the temporarily stored additive to the pipe 54.

The output unit 52*a* includes a feeder (not shown) for feeding the additive stored in the additive agent supply unit 52 to the pipe 54, and a shutter (not shown) for opening and closing a path connecting the feeder and the pipe 54. When this shutter is closed, a path or an opening connecting the output unit 52*a* and the pipe 54 is closed, and supply of the additive from the additive agent supply unit 52 to the pipe 54 is stopped.

The additive is not supplied from the output unit 52*a* to the pipe 54 when a feeder of the output unit 52*a* is not in operation. However, even if the feeder of the output unit 52*a* is stopped, an additive may flow to the tube 54 when a negative pressure is generated in the pipe 54. By closing the output unit 52*a*, the flow of such additive can be reliably shut off.

The resin contained in the binding agent in the additive is melted by heat and binds the plurality of fibers together. Therefore, the fibers are not bound together unless they are heated to the temperature at which resin melts in the state in which resin is mixed with fiber.

In addition, the additive supplied by the additive agent supply unit 52 may include binding agents for binding fibers as well as coloring agents for coloring fibers, coagulation inhibitors for preventing aggregation of fibers or aggregation of resins, flame retardants for preventing flaming of fibers and the like, depending on the type of sheet to be manufactured.

Due to the air flow generated by the mixing blower 56, the subdivided material P which falls in the pipe 7 and the additive supplied by the additive agent supply unit 52 are suctioned into the pipe 54 and pass inside the mixing blower 56. By the air flow generated by the mixing blower 56 and/or the action of the rotary unit such as blades of the mixing blower 56, the fibers constituting the subdivided material P and the additive are mixed, and the mixture (mixture of the first screened product and the additive) is transported to the deposition unit 60 via the pipe 54.

The mechanism for mixing the first screened product and the additive is not particularly limited, and may be stirring with a blade rotating at high speed, or using rotation of the container such as a V-type mixer. These mechanisms may be disposed before or after the mixing blower 56.

The deposition unit 60 deposits the defibrated material defibrated by the defibrating unit 20. More specifically, the deposition unit 60 introduces the mixture which has passed the mixing unit 50 from the inlet port 62, and disentangles the intertwined defibrated material (fibers) for falling while dispersing in the air. Accordingly, the deposition unit 60 can uniformly deposit the mixture on the second web forming unit 70.

The deposition unit 60 includes a drum unit 61, and a housing unit (cover unit) 63 that houses the drum unit 61. The drum unit 61 is a cylindrical sieve driven by a motor. The drum unit 61 has a mesh (filter, screen), and functions as a sieve. With this mesh, the drum unit 61 passes fibers and particles smaller than the size of the mesh aperture (opening) and allows them to fall from the drum unit 61. The configuration of drum unit 61 is the same as the configuration of the drum unit 41, for example.

The "sieve" of the drum unit 61 may not necessarily have a screening function for a specific object. That is, the "sieve" used as the drum unit 61 refers to one having a mesh, and the drum unit 61 may cause all the mixtures introduced therein to fall from the drum unit 61.

The second web forming unit 70 is disposed under the drum unit 61. The second web forming unit 70 deposits the material that has passed the deposition unit 60 to form a second web W2. The second web forming unit 70 includes, for example, a mesh belt 72, a roller 74, and a suction mechanism 76.

The mesh belt 72 is an endless belt, and is carried by a plurality of rollers 74 and transported by the movement of the rollers 74 in a direction indicated by the arrow in the figure. The mesh belt 72 is made of, for example, metal, resin, cloth, or non-woven fabric. The surface of mesh belt 72 is configured by a mesh in which openings of a predetermined size are arranged. Among the fibers and particles falling from the drum unit 61, fine particles of the size that passes through the mesh falls under the mesh belt 72, and the fibers of the size that does not pass the mesh are deposited on the mesh belt 72, and transported together with the mesh belt 72 in the arrow direction. The mesh belt 72 moves at a constant speed V2 during normal operation for manufacturing the sheet S. The normal operation is as described above.

The mesh belt 72 has a fine mesh, and the size may be that does not pass most of the fibers and particles falling from the drum unit 61.

The suction mechanism 76 is disposed under the mesh belt 72 (on the side opposite to the deposition unit 60). The suction mechanism 76 is provided with a suction blower 77, and the suction force of the suction blower 77 can generate an air flow directed downward from the suction mechanism 76 (air flow from the deposition unit 60 toward the mesh belt 72).

The suction mechanism 76 suctions the mixture dispersed by the deposition unit 60 into the air onto the mesh belt 72. This promotes formation of the second web W2 on the mesh belt 72, and increase the discharging speed from the deposition unit 60. In addition, the suction mechanism 76 can form a downflow in the falling path of the mixture, and can prevent the defibrated material and additives from entangling during descending.

The suction blower 77 (deposit suction unit) may exhaust air suctioned from the suction mechanism 76 to the outside of the sheet manufacturing apparatus 100 through a collection filter (not shown). Alternatively, the air suctioned by the suction blower 77 may be fed into the dust collecting unit 27, and the removal material contained in the air suctioned by the suction mechanism 76 may be collected.

The humidification unit 208 supplies humidified air to the space including the drum unit 61. With this humidified air, the inside of the deposition unit 60 can be humidified, and thus adhesion of fibers and particles to the housing portion 63 by electrostatic force can be reduced, and the fibers and particles can rapidly fall onto the mesh belt 72. Accordingly, the second web W2 with a desired shape can be formed.

As described above, by passing the deposition unit 60 and the second web forming unit 70 (web forming step), the second web W2 containing a large amount of air and in a softly inflating state is formed. The second web W2 deposited on the mesh belt 72 is transported to the sheet forming unit 80.

In the transport path of the mesh belt 72, air which contains mist is supplied at a position downstream to the deposition unit 60 by the humidification unit 212. As a result, mist generated by the humidification unit 212 is supplied to the second web W2, and the amount of water contained in the second web W2 is adjusted. Accordingly, adhesion of fibers to the mesh belt 72 due to static electricity can be reduced.

The sheet manufacturing apparatus 100 includes a transport unit 79 that transports the second web W2 on the mesh belt 72 to the sheet forming unit 80. The transport unit 79 includes, for example, a mesh belt 79*a*, a roller 79*b*, and a suction mechanism 79*c*.

The suction mechanism 79*c* is provided with a blower (not shown), and generates an upward air flow on the mesh belt 79*a* by a suction force of the blower. This air flow suctions the second web W2, and the second web W2 is separated from the mesh belt 72 and attracted to the mesh belt 79*a*. The mesh belt 79*a* moves by the rotation of the roller 79*b*, and transports the second web W2 to the sheet forming unit 80. The moving speed of mesh belt 72 and the moving speed of mesh belt 79*a* are the same, for example.

Thus, the transport unit 79 transports the second web W2 formed on the mesh belt 72 by peeling it from the mesh belt 72.

The sheet forming unit 80 forms the sheet S from the deposited material deposited by deposition unit 60. More specifically, the sheet forming unit 80 forms the sheet S by pressing and heating the second web W2 (deposited material) deposited on the mesh belt 72 and transported by the transport unit 79. In the sheet forming unit 80, heat is applied to the fibers and additive in the defibrated material contained in the second web W2 to bind the plurality of fibers in the mixture by the binding agent (resin) in the additive.

The sheet forming unit 80 includes a pressurizing unit 82 for pressing the second web W2, and a heating unit 84 for heating the second web W2 pressed by the pressurizing unit 82.

The pressurizing unit 82 is configured with a pair of calendar rollers 85, and sandwiches and presses the second web W2 with a predetermined nip pressure. As the second web W2 is pressed, the thickness of the second web W2 reduces, and thus the density of the second web W2 is increased. One of the pair of calendar rollers 85 is a driving roller driven by a motor (not shown), and the other is a driven roller. The calendar rollers 85 are rotated by the driving force of the motor, and transports the second web W2 having a high density due to pressure to the heating unit 84.

The heating unit 84 includes a pair of heat rollers 86. The heat roller 86 is heated by an internal or external heater to a predetermined temperature. The heat roller 86 sandwiches the second web W2 pressed by the calendar roller 85 and applies heat to form the sheet S.

One of the pair of heat rollers 86 is a driving roller driven by a motor (not shown), and the other is a driven roller. The heat roller 86 rotates by the driving force of the motor, and transports the heated sheet S toward the cutting unit 90.

Thus, the second web W2 formed by the deposition unit 60 is pressed and heated in the sheet forming unit 80 to form the sheet S.

The number of the calendar rollers 85 provided in the pressurizing unit 82 and the number of heat rollers 86 provided in the heating unit 84 are not particularly limited.

The cutting unit 90 cuts the sheet S formed by the sheet forming unit 80. In the embodiment, the cutting unit 90 has a first cutting unit 92 for cutting the sheet S in the direction intersecting with the transport direction of the sheet S, and a second cutting unit 94 for cutting the sheet S in the direction parallel to the transport direction. The second cutting unit 94 cuts, for example, the sheet S which has passed the first cutting unit 92.

Thus, a single-cut sheet S of a predetermined size is formed. The sheet S thus cut is fed out to the output unit 96. The output unit 96 has a tray or stacker on which the sheets S of a predetermined size are placed.

In the above configuration, the humidification units 202, 204, 206, and 208 may be configured by one vaporizing humidifier. In this case, humidified air generated by one humidifier may be branched and supplied to the crushing unit 12, the housing unit 43, the pipe 7, and the housing unit 63. This configuration can be easily realized by providing a branched duct (not shown) for supplying humidified air. It is also possible to configure the humidification units 202, 204, 206 and 208 by two or three vaporizing humidifiers.

In the above configuration, the humidification units 210 and 212 may be configured by one ultrasonic humidifier or may be configured by two ultrasonic humidifiers. For example, air which contains mist generated by one humidifier can be branched and supplied to the humidification units 210 and 212.

In the above configuration, the crushing unit 12 first crushes the raw material, and the sheet S is produced from the crushed raw material. However, it is also possible, for example, to use fiber as the raw material to produce the sheet S. For example, a fiber similar to the defibrated material defibrated by the defibrating unit 20 may be used as a raw material and loaded into the drum unit 41. Further, a fiber similar to the first screened product separated from the defibrated material may be used as a raw material and loaded into the pipe 54. In this case, the sheet S can be produced by supplying fibers made of waste paper, pulp and the like to the sheet manufacturing apparatus 100.

In the above sheet manufacturing apparatus 100, the heat roller 86 is a heat treatment section for heating the web W2. That is, in the sheet manufacturing apparatus 100, a plurality of fibers are bound by the heat treatment section.

In the sheet manufacturing apparatus 100, the calendar roller 85 is one embodiment of removing the binding agent from the deposited material of the mixture of fiber and binding agent without melting the binding agent before melting the binding agent. As the web W2 passes the calendar roller 85 of the pressurizing unit 82, the distribution of the binding agent in the sheet described above can be formed.

Further, the heating unit 84 provided with a pair of heat rollers 86, that is, a heat treatment section, is provided at a position downstream to the pressurizing unit 82. That is, the pressurizing unit is disposed upstream to the heat treatment section in the transport direction of the web or sheet. The material for the surface of the calendar roller 85 may include one or more of polysilicone, polyvinyl chloride, copolymer of acrylonitrile and 1,3-butadiene, and chloroprene rubber.

The sheet of the present embodiment described above is, for example, manufactured by the sheet manufacturing apparatus 100.

2.2. Laser Printer

A laser printer can be an exemplary sheet processing apparatus. The following describes an essential part of a laser printer.

Figure 6:
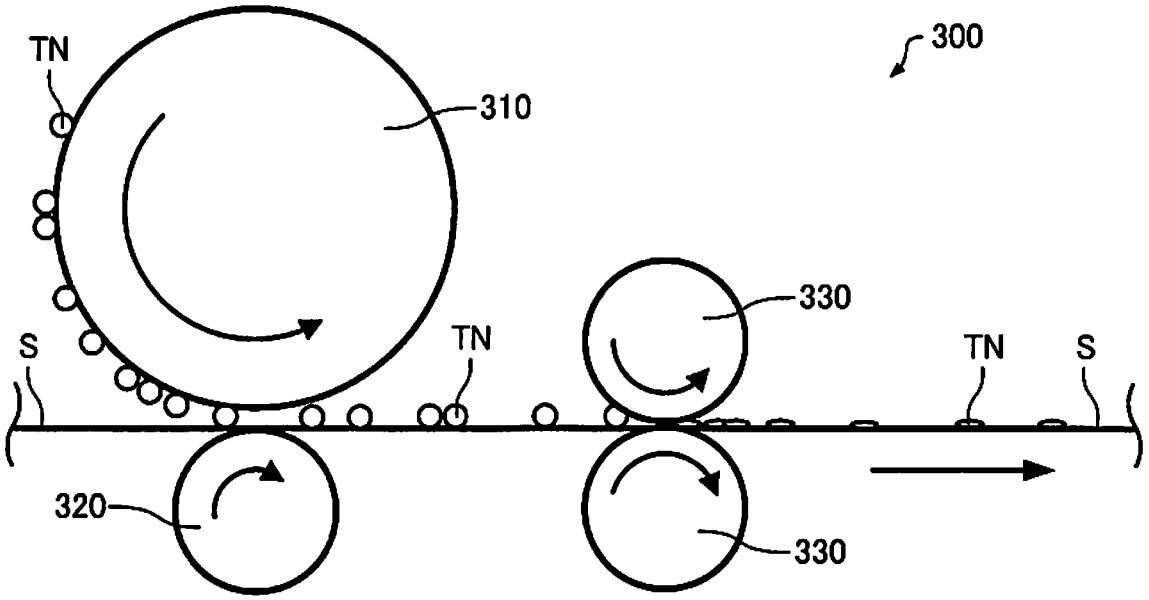
FIG. 6 is a schematic diagram illustrating an outline of an essential part of a laser printer according to an embodiment.

FIG. 6 is a schematic diagram illustrating an outline of an essential part of a laser printer according to the present embodiment. In FIG. 6, for the convenience of description, the respective components, a toner TN, and the sheet S are not to scale. A laser printer 300 of the present embodiment at least includes a photosensitive drum 310 that transfers a toner TN onto a sheet, a transfer roller 320 that transfers the toner TN from the photosensitive drum 310 onto the sheet S, and a fixing roller 330 that fixes the toner TN onto the sheet S.

The laser printer 300 records an image made of toner on a recording medium such as a sheet by a series of image formation processes including exposure, development, transfer, and fixing. As shown in FIG. 6, the laser printer 300 has a photosensitive drum 310 that rotates in the arrow direction indicated in the drawing, and a charging unit, an exposure unit, a development unit, etc. (not shown) are sequentially arranged along the rotation direction. Further, as shown in FIG. 6, the laser printer 300 includes a fixing roller 330.

In the laser printer 300, the photosensitive drum 310 and the transfer roller 320 start rotating according to a command from a host computer (not shown). Then, the photosensitive drum 310, while rotating, is sequentially charged by the charging unit. As the photosensitive drum 310 rotates, the charged area of the photosensitive drum 310 reaches an exposure position, and a latent image corresponding to image information is formed in the area by the exposure unit.

As the photosensitive drum 310 rotates, the latent image formed on the photosensitive drum 310 reaches a development position, and is developed with the toner TN by the development unit for development. Thus, a toner TN image is formed on the photosensitive drum 310.

As the photosensitive drum 310 rotates, the toner TN image formed on the photosensitive drum 310 reaches a transfer position (in the illustrated example, the portion where the photosensitive drum 310 and the transfer roller 320 face each other), and the image is transferred onto the sheet S by the transfer roller 320. A transfer voltage (transfer bias) having a polarity opposite to the charge polarity of the toner TN is applied to the transfer roller 320.

Although not shown, after the photosensitive drum 310 passed the transfer position, the toner remaining on the surface is scraped off by a cleaning blade or the like to prepare for charging for forming the next latent image. The scraped toner is collected in a toner collection unit.

The toner image transferred to the sheet S is heated and pressed by the fixing roller 330 and fused to the sheet S. Thereafter, in the case of single-sided print, the sheet S is outputted to the outside of the laser printer 300 by an output roller (not shown).

The above is an outline of the laser printer 300. The laser printer 300 may have various rollers, various transfer belts, and the like as components. The laser printer 300 may be a monochrome printer or a color printer, or may also be configured to adhere the toner on both sides.

In the above printer 300, the fixing roller 330 is a heat treatment section for heating the sheet S. That is, in the laser printer, the toner is fixed to the sheet by the heat treatment section.

The sheet of the present embodiment described above can be processed by the laser printer 300.

3. Sheet Processing Method

The sheet processing method of the present embodiment includes the step of applying heat treatment to a sheet including a plurality of fibers and a binding agent for binding the plurality of fibers.

In the sheet processing method of the present embodiment, the step of applying heat treatment to a sheet including a plurality of fibers and a binding agent for binding the plurality of fibers can be easily performed by the heat roller 86 of the sheet manufacturing apparatus 100 described above. In the sheet manufacturing apparatus 100, the sheet before heating is the web W2, and when the sheet processing method is performed by the sheet manufacturing apparatus 100, a plurality of fibers are bound by the step of applying heat treatment.

On the other hand, in the sheet processing method of the present embodiment, the step of applying heat treatment to a sheet including a plurality of fibers and a binding agent for binding the plurality of fibers can be easily performed by the fixing roller 330 of the laser printer 300 described above. In the laser printer 300, a plurality of fibers have been already bound in the sheet before heating, and when the sheet processing method is performed by the laser printer 300, the toner is fixed to the sheet by the step of applying heat treatment.

4. Conditions in Sheet Processing Apparatus and Sheet Processing Method

High-performance laser printers have faster processing speeds, faster sheet transport speeds, and more stress on the sheets. In the high-speed laser printer, a phenomenon in which a sheet is bent and stuck in the sheet transport path has occasionally occurred. The present inventors have made intensive studies and found that the main reason for this is insufficient resilience of the sheet, and, when the sheet is slightly caught, it is not strong enough to eliminate this, resulting in bending of the sheet. According to further examination, it was found that such transport failure of the sheet was often observed in the type of high-speed laser printer with increased inner temperature.

The sheets have various thicknesses depending on the application. In the thermoplastic resin, Tg largely depends on molecular structure of the resin and imparts various values to the sheet, and accordingly, the resin to be used is appropriately selected. In designing a sheet for a specific application, thermal design of the resin used for the binding agent requires trial and error.

As a result of many experiments, the present inventors have empirically found that it is possible to reduce a failure of the sheet sticking to a roller when passing the heat treatment section which is configured by the roller by satisfying the following conditions. Such conditions are that the temperature Ts (° C.) of the sheet after heat treatment section (after heat treatment), Tg (° C.) of the resin contained in the binding agent, and the thickness D (μm) of the sheet satisfy the following formula. Further, the following formula (1) is an empirical formula, and dimensions are not the same.

$$Tg \geq Ts - 0.3 \times D \quad (1)$$

Table 1 shows the result of calculation of Tg when "Tg=Ts−0.3×D" for the practical range of Ts (° C.) and D (μm). In Table 1, from the relationship between the sheet thickness and the surface temperature of the sheet, it was empirically found that it is preferred to set the Tg (° C.) of the resin contained in the binding agent to a value greater than the value calculated based on the formula (1).

TABLE 1

| Calculation result for Tg: Tg = Ts − 0.3D (° C.) | | | |
|---|---|---|---|
| Sheet surface temperature | Sheet thickness 80 μm | Sheet thickness 100 μm | Sheet thickness 110 μm |
| 85° C. | 61.0 | 55.0 | 52.0 |
| 90° C. | 66.0 | 60.0 | 57.0 |
| 95° C. | 71.0 | 65.0 | 62.0 |
| 100° C. | 76.0 | 70.0 | 67.0 |

The glass transition temperature (Tg) of the resin contained in the binding agent is the value measured under the following conditions. In the measurement, 10 mg of the sample is measured in an aluminum pan using a differential scan calorimeter (Rigaku Co., Ltd./DSC8231). In the first temperature rising process in which the temperature is raised from 20° C. to 150° C. at the temperature rising rate of 10° C./min and held at 150° C. for 10 minutes, the temperature lowering process in which the temperature is lowered from 150° C. to 0° C. at the temperature lowering rate of 10° C./min and held at 0° C. for 10 minutes, and the second temperature rising process in which the temperature is raised from 0° C. to 150° C. at the temperature rising rate of 10° C./min, an intersection point between the extension of the baseline on the low temperature side of the second temperature rising process and the tangent drawn at the point where the slope of the curve of the stepwise change of the glass transition is maximum is the glass transition temperature. In addition, in this measurement, nitrogen gas was flowed at a flow rate of 2 ml/min in order to make the inside of the furnace of the measuring machine have a nitrogen atmosphere.

The sheet thickness D (μm) is measured according to "JISP8118:2014 (Paper and board—determination of thickness, density and specific volume)" by using a micrometer. During thickness measurement, the pressure applied between the pressure surfaces is 100 kPa±10 kPa.

The temperature Ts (° C.) of the sheet after passing the heat treatment section is the sheet temperature after passing the heat roller of the sheet manufacturing apparatus or the fixing roller of the laser printer. The temperature is measured in a non-contact manner, for example, by a radiation thermometer.

The temperature Ts (° C.) of the sheet after passing the roller is the surface temperature of the sheet after the sheet exits the nip of the roller while the sheet is transported by the rotating roller. The temperature Ts (° C.) is temporally measured at a position 1.0 second after the sheet exits the nip of the roller. Therefore, the measurement position depends on the transport speed of the sheet by the roller. Ts varies with the process conditions.

The sheet processing method and the sheet processing apparatus of the present embodiment described above satisfy the relationship of the above formula (1). Further, the sheet for the laser printer described above is hard to stick to the fixing roller when passing the heat treatment section of the laser printer due to the distribution of the binding agent, and jamming is less likely to occur. In addition, when the temperature Ts (° C.) of the sheet after passing the heat treatment section, the Tg (° C.) of the resin contained in the binding agent, and the thickness D (μm) of the sheet are set to satisfy the above formula (1), jamming can be further reduced during passing through the heat treatment section.

Further, by setting the relationship of the above formula (1) to one of the design guidelines, it is possible to calculate Tg of the resin to be satisfied from the surface temperature of the sheet after passing the heat treatment section and the thickness of the sheet. Therefore, for example, it is possible to reduce the time and effort of repeating the experiment by making samples of material or sheet for the design of resin.

5. Examples

In the following description, embodiments of the disclosure will be more detailed by way of examples. However, the disclosure is not limited to these examples. Hereinafter, "parts" and "%" are based on mass unless otherwise specified.

5.1. Evaluation of Surface Resistivity

The sheet samples used for the measurement of the surface resistivity are as shown in Table 2.

TABLE 2

| Type | Description | Surface resistivity Rs (Ω/□) | | Applied voltage |
|---|---|---|---|---|
| Dry process sheet | Sheet with reduced surface concentration (n = 2) | 93 | $\times 10^{10}$ | 100 V/min |
| | | 71 | | |
| | Sheet with normal surface concentration (n = 2) | 332 | | |
| | | 343 | | |
| Plain paper | α Eco Paper Type TR | 37 | | |
| | PPC paper sheet N70 | 73 | | |
| | Copy Paper Standard Type II | 97 | | |
| | Recycling cutting size G80 | 19 | | |

In Table 2, the "sheet with reduced surface concentration" is a sheet manufactured by the above-mentioned sheet manufacturing apparatus 100, in which the abundance of the binding agent near the surface is approximately 50% of the abundance near the center in the thickness direction. In Table 2, the "sheet with normal surface concentration" is a sheet manufactured by the above-mentioned sheet manufacturing apparatus 100, and the sheet was taken out without passing the calendar roller 85 of the pressurizing unit 82 and the heat roller 86 of the heating unit 84, and formed by a heat press with enhanced surface peelability. The abundance of the binding agent near the center and near the surface in the thickness direction are approximately the same. The binding agent used was the one using the resin Vylon 220 in Table 3, and the proportion contained in the sheet was 20% in the preparation composition.

In Table 2, "a Eco Paper Type TR" was a commercially available plain paper manufactured by Otsuka Shokai Co., Ltd., "PPC paper sheet N70" was a commercially available plain paper manufactured by Nippon Paper Industries Co., Ltd., "Copy Paper Standard Type II" was a commercially available plain paper manufactured by Cownet Co., Ltd., and "Recycling cutting size G80" was a commercially available plain paper manufactured by Toppan Forms Inc.

The surface resistivity was measured by Hiresta UP (MCP-HT450) manufactured by Mitsubishi Chemical Analytech Co., Ltd. The voltage applied to the electrode was 100V, and the voltage applied for measurement was 1 minute. Moreover, the measurement was performed twice (n=2) for the "sheet with reduced surface concentration" and the "sheet with normal surface concentration." Table 2 shows the measurement results of the surface resistivity Rs.

5.2. Evaluation of Processing Conditions

The sheets were produced by the sheet manufacturing apparatus 100 to have three different thickness levels, and polyesters with different Tg shown in Table 3 were used as the binding agent.

The binding agent was prepared by the following method. A raw material resin to be processed into a binding agent was introduced into a twin-screw extrusion kneader, melt-kneaded at 90° C. to 130° C., and then taken out on a cooling roll to be flaked. The flakes were roughly crushed by a hammer mill and then finely ground by a jet mill. Then, the particles were classified by a forced vortex centrifugal classifier to adjust the particle size distribution, and resin powder having a volume average particle diameter of 10 to 12 μm was obtained. The volume average grain size was measured by Multisizer 3 (Beckman Coulter). To this resin powder, 2 parts of fumed silica RX200 manufactured by Nippon Aerosil Co., Ltd. was measured per 100 parts by weight of the resin powder, and mixed well by a high-speed mixer, and used as a binding agent.

TABLE 3

| Model No. | Manufacturer | Tg (° C.) catalogue value | Molecular weight Mn | Example No. |
|---|---|---|---|---|
| Vylon 103 | Toyobo Co., Ltd. | 47.0 | 23000 | 1 |
| Vylon 220 | | 53.0 | 3000 | 2 |
| Vylon 245 | | 60.0 | 19000 | 3 |
| Vylon 226 | | 65.0 | 8000 | 4 |
| Vylon 296 | | 71.0 | 14000 | 5 |
| Vylon 885 | | 79.0 | 8000 | 6 |

The prepared sheets of the examples were set in a modified laser printer (manufactured by Seiko Epson, LP-S5500), and the temperature of the fixing roller was adjusted to set the surface temperature of the sheet at the value shown in Table 4. One hundred test patterns according to JIS X 6931 (ISO/IEC 19798) were printed in monochrome. The surface temperature of the sheet after passing the fixing roller was measured by a handy type radiation thermometer (Chino Corporation/IR-TAP), and the center of the sheet in the width direction was measured at a distance of 1 second after passing the nip of the roller. Then, the sheet passage rate was evaluated based on the following determination criteria, and the results are shown in Table 4.

A: 100 sheets passed

B: 96 or more and 99 or less sheets passed

C: Less than 95 sheets passed

TABLE 4

| Sheet surface temperature | Tg (° C.) of resin in binding agent | Sheet thickness 80 μm | Sheet thickness 100 μm | Sheet thickness 110 μm |
|---|---|---|---|---|
| 85° C. | 47.0 | C | C | C |
| | 53.0 | C | B | B |
| | 60.0 | B | A | A |
| | 65.0 | A | A | A |
| | 71.0 | A | A | A |
| | 79.0 | A | A | A |
| Temperature for formula (1) with equal sign | | 61.0 | 55.0 | 52.0 |
| 90° C. | 47.0 | C | C | C |
| | 53.0 | C | C | C |
| | 60.0 | C | A | A |
| | 65.0 | B | A | A |
| | 71.0 | A | A | A |
| | 79.0 | A | A | A |
| Temperature for formula (1) with equal sign | | 66.0 | 60.0 | 57.0 |
| 95° C. | 47.0 | C | C | C |
| | 53.0 | C | C | C |
| | 60.0 | C | C | B |
| | 65.0 | C | B | A |
| | 71.0 | A | A | A |
| | 79.0 | A | A | A |
| Temperature for formula (1) with equal sign | | 71.0 | 65.0 | 62.0 |
| 100° C. | 47.0 | C | C | C |
| | 53.0 | C | C | C |
| | 60.0 | C | C | C |
| | 65.0 | C | C | C |
| | 71.0 | C | A | A |
| | 79.0 | A | A | A |
| Temperature for formula (1) with equal sign | | 76.0 | 70.0 | 67.0 |

Table 4 also shows the Tg for the formula (1) with equal sign, "Tg=Ts−0.3×D".

5.3. Summary of Results

In the above table, 96% or more of the sheets using a resin having the glass transition temperature of Tg or more for "Tg=Ts−0.3×D" (that is, "Tg≥Ts−0.3×D") passed the heat treatment section (fixing roller). Although there were 4 cases of "B" determination, all others cases were "A" determination. That is, it was found that, by selecting the material according to the formula (1), it was possible to predict the passage of sheet under the assumed process conditions.

In the case of "Tg<Ts−0.3×D", although there were 2 cases of "B" determination, all others cases were "C" determination as expected.

Although the reason why the passage of the sheet is difficult under the condition of "Tg<Ts−0.3×D" is not clearly understood, the following reason can be roughly considered. When the surface of a member is subjected to high temperature due to the influence by the machine temperature in a process having a roller or the like, the temperature of the sheet touching the surface of the member also rises. The amount of heat given to the sheet is considered to be proportional to the time of touching the member and the surface temperature of the member. As a result of observation of the case where the passage of the process failed, there were many cases where the sheet was bent. Accordingly, it was expected that, due to a decrease in rigidity of the sheet immediately after passing the process, the resiliency (rigidity) of the sheet sufficient to bear the transport, overcoming catching of the member or a tack force to the contact section, was lost. The reason for lowering of the rigidity of the sheet seems to be that the resin for improving sheet strength tends to soften at high temperature. The temperature at which the resin is softened is related to the glass transition temperature in the case of thermoplastic resin, and in the region beyond this temperature, softening gradually occurs.

Further, the sheet has thickness, and even if the surface temperature is higher than the softening temperature of resin, the rigidity of the sheet is generally maintained if the inside of the sheet is not more than that temperature. Therefore, as the sheet thickness varies, the process passing rate changes accordingly. Since heat conduction is time-dependent, it takes more time for the thick sheet to reach high temperature at the center. In particular, in the sheet containing fibers and having a void fraction, the air contained in the sheet (void) increases the heat insulation effect. Accordingly, the temperature of the center of the sheet seems to largely depend on the thickness of the sheet. For example, the heat roller is a process in which the passage is completed before the center reaches high temperature because the time for which sheet is heated is shortened. In such a case, even if the surface of the sheet is at a high temperature, the resin does not soften at the center and the rigidity of the sheet is maintained, and the process passing rate was good for the higher sheet surface temperature.

The Tg of the resin used as the binding agent for forming a sheet having high strength even in a high temperature range is related to the surface temperature Ts and the thickness D of the sheet, and it is considered that the relationship is represented by the above formula (1). In addition, the formula (1) is not based on the theoretical calculation or numerical simulation, and is an empirical rule obtained from many experiments. Therefore, it does not completely exclude the possibility of non-applicable cases. However, by the material design that satisfies the above formula (1), it is possible to obtain a sheet with high strength even in a high temperature range, and this can ensure the transport stability in the laser printer.

The disclosure is not limited to the above embodiments, and various modifications are possible. For example, the disclosure includes configurations which is substantially the same as the configurations described in the embodiments (for example, configurations having the same function, method, and results, or configurations having the same purpose and effect). Further, the disclosure includes configurations in which non-essential part of the configuration described in embodiments is replaced. Further, the disclosure includes configurations having the same advantageous effects as the configurations described in the embodiments or configurations capable of achieving the same object. Further, the disclosure includes configurations in which known techniques are added to the configurations described in the embodiments.

The entire disclosures of Japanese Patent Application No. 2018-118714 filed Jun. 22, 2018 is expressly incorporated herein by reference.

What is claimed is:

1. A sheet for a laser printer, the sheet comprising:

a plurality of fibers; and a binding agent for binding the plurality of fibers, wherein an abundance of the binding agent on a surface of the sheet is smaller than an abundance of the binding agent in a center in a thickness direction of the sheet, and a glass transition temperature Tg (° C.) of a resin contained in the binding agent, a temperature Ts (° C.) of the sheet after passing a heat treatment section in the laser printer, and a thickness D (μm) of the sheet satisfy a formula (1):

$$Tg \geq Ts - 0.3 \times D \quad (1).$$

2. A sheet for a laser printer, the sheet comprising:

a plurality of fibers: and a binding agent for binding the plurality of fibers, wherein an abundance of the binding agent on a surface of the sheet is smaller than an abundance of the binding agent in a center in a thickness direction of the sheet, and a surface resistivity Rs (Ω/□) of the sheet is $1.0 \times 10^{12}$ (Ω/□) or less.

3. A method for processing a sheet, comprising:

applying heat treatment to a sheet including a plurality of fibers, and a binding agent for binding the plurality of fibers, wherein a glass transition temperature Tg (° C.) of a resin contained in the binding agent, a temperature Ts (° C.) of the sheet after the heat treatment, and a thickness D (μm) of the sheet satisfy a formula (1):

$$Tg \geq Ts - 0.3 \times D \quad (1).$$

4. The method for processing a sheet according to claim 3, wherein the plurality of fibers are bound by the applying heat treatment.

5. The method for processing a sheet according to claim 3, wherein a toner is fixed to the sheet by the applying heat treatment.

6. A sheet processing apparatus, comprising:

a heat treatment section that applies heat to a sheet which includes a plurality of fibers, and a binding agent for binding the plurality of fibers, wherein a glass transition temperature Tg (° C.) of a resin contained in the binding agent, a temperature Ts (° C.) of the sheet after passing the heat treatment section, and a thickness D (μm) of the sheet satisfy a formula (1):

$$Tg \geq Ts - 0.3 \times D \quad (1).$$

7. The sheet processing apparatus according to claim 6, wherein the plurality of fibers are bound by the heat treatment section.

8. The sheet processing apparatus according to claim 6, further comprising:

a pressurizing unit that pressurizes the sheet at a position upstream to the heat treatment section in a transport direction of the sheet.

9. The sheet processing apparatus according to claim 8, wherein the pressurizing unit is a roller, and a material of a surface of the roller includes one or more of polysilicone, polyvinyl chloride, copolymer of acrylonitrile and 1,3-butadiene, and chloroprene rubber.

10. The sheet processing apparatus according to claim 6, wherein a toner is fixed to the sheet by the heat treatment section.

11. The sheet processing apparatus according to claim 6, wherein the heat treatment section is a heat roller.

* * * * *